United States Patent [19]

Garnsworthy

[11] 4,407,117

[45] Oct. 4, 1983

[54] JOINING OF YARNS BY SPLICING

[76] Inventor: Russell K. Garnsworthy, 1 Fenland Ct., Highton, Victoria, Australia

[21] Appl. No.: 260,553

[22] Filed: May 5, 1981

[30] Foreign Application Priority Data

May 5, 1980 [AU] Australia ..... PE3407

[51] Int. Cl.[3] ..... D01H 15/00

[52] U.S. Cl. ..... 57/22; 57/261

[58] Field of Search ..... 57/22, 1, 261, 263, 57/301, 302; 242/35.5 R, 35.5 A, 35.6 R, 37 A, 147 A

[56] References Cited

U.S. PATENT DOCUMENTS

| | | | |
|---|---|---|---|
| 3,307,339 | 3/1967 | Porter | 57/22 |
| 3,315,458 | 4/1967 | Alexander | 57/22 |
| 3,903,680 | 9/1975 | Isern | 57/22 |
| 4,170,103 | 10/1979 | Norris | 57/22 |

*Primary Examiner*—Donald Watkins

*Attorney, Agent, or Firm*—Sughrue, Mion, Zinn, Macpeak and Seas

[57] ABSTRACT

A method for the splicing of two twisted staple yarns includes the steps of untwisting portions of each yarn, drafting these portions to form beards and retwisting the beards to form the splice. In one aspect of the invention, the untwisting is effected by rolling the yarns between two surfaces at nip point to rotate the yarns. In a second aspect, each yarn is gripped between nips at two locations (defining the respective yarn portion) which are spaced apart by a distance not significantly greater than the mean yarn fibre length; after untwisting, the beards are formed by drawing the ends of the yarns in opposite directions and longitudinally through the adjacent nips, whereby both ends of each beard are held between the nips defining the respective yarn portion. Also disclosed is apparatus for carrying out the respective aspects of the method.

18 Claims, 5 Drawing Figures

JOINING OF YARNS BY SPLICING

This invention relates to the joining of twisted staple yarns by splicing.

The common method of restoring broken textile yarns is to apply a knot. Knots, however have shortcomings such as snagging, slipping and parting during ordinary textile processing. Additionally, knots remain visible in the subsequent knitted, woven or tufted article and the practice is for skilled personnel to inspect the article and to mend out the knots by hand.

One known approach to the splicing of twisted staple yarns entails the use of a pneumatic splicer, and an example of this approach is to be found in United Kingdom patent specification 1175621. Pneumatic splicers are characterized by the application of air jets to the overlayed ends of the yarns to be spliced, or of the broken yarn, so as to cause the fibres at the respective ends to interact by being intermingled and twisted together. Although success has been achieved in producing substantially undetectable joins, it is found in practice that the strength of the spliced yarn is somewhat unreliable.

Other proposals put forward for the splicing of yarns involve the basic steps of gripping each yarn at two spaced locations near its end, untwisting the portion of yarn thereby defined, moving the gripping points apart to draw and break each portion of yarn to form a beard and retwisting or entangling the two beards to form the splice. Mechanisms which form the splice by retwisting the beards and which perform all these steps in an automatic sequence, e.g. U.S. Pat. Nos. 2,362,801, 3,307,339 and 2,515,172 and U.K Pat. No. 2,026,555, tend to be complex, costly and difficult to maintain. Mechanisms which form the splice by entanglement—as by the use of an air-blast after the manner of U.K. Pat. Nos. 991,229 and 1,121,597—offer less complexity, but the quality of the splice is poor, i.e. non-uniform and likely to part.

Two problems are common to these prior art techniques involving untwisting and drafting. First, because the twist-level along a normal yarn varies significantly about a mean, it is difficult to completely untwist a yarn prior to beard formation without visual inspection and manual adjustment: failure to completely untwist prevents the formation of a proper beard and, therefore, a weak or bulky splice. Second, having formed the two beards, it is then difficult to control and manipulate them so as to ensure their proper entanglement or retwisting to form a reliable splice.

To the applicant's knowledge, solutions to the first problem have not been proposed in the art and, indeed, the problem does not appear to have been appreciated. Recently, however, an attempt at solving the second problem has been proposed in U.K. Pat. No. 1,470,787 wherein one beard is electrostatically charged to form it into a bell mouth and the second (uncharged) beard is inserted therein prior to retwisting. While attractive in theory, the manipulation of the wispy beards—particularly the prevention of charge transference to the uncharged beard—is a significant problem. The complexity and cost of a mechanism incorporating these additional features is considerably increased.

It is therefore the general objective of the present invention to provide an improved yarn splicing method and apparatus which will mitigate either or both of the problems mentioned without undue complexity, cost and unreliability.

Essentially, the problem of variable twist levels along the length of the yarn is met, in accordance with the present invention, by effecting the untwisting action of rolling the yarns by friction between two surfaces and relying upon the fact that yarn portions which have higher twist levels are smaller in diameter than those which have lower twist levels. The problem of beard control is met by forming the beards in close proximity and holding both ends of each beard prior to retwisting.

In one aspect, the invention accordingly provides a method for the splicing of two twisted staple yarns by untwisting portions of each yarn, drafting said portions to part the yarns and form two beards and retwisting the beards to form a splice, characterized in that the untwisting is effected by rolling the yarns between two surfaces at nip point to rotate the yarns.

In a further aspect of the invention, there is provided a method for the splicing of two twisted staple yarns by untwisting portions of each yarn, drafting said portions to form beards and retwisting the beards to form the splice, characterized in that each yarn is gripped between nips at two locations (defining the respective yarn portion) which are spaced apart by a distance not significantly greater than the mean yarn fibre length and characterized in that, after untwisting, the beards are formed by drawing the ends of the yarns in opposite directions and longitudinally through the adjacent nips, whereby both ends of each beard are held between the nips defining the respective yarn portion.

The invention also provides apparatus for the splicing of two twisted staple yarns comprising untwisting means for untwisting portions of each yarn and drafting means for drafting said portions to part the yarns and form two beards, said twisting means or other means being arranged to then retwist the beards to form a splice, characterized in that the twisting means comprises two surfaces at nip point for rolling and thereby rotating the yarns.

The invention still further provides apparatus for the splicing of two twisted staple yarns comprising twisting means for untwisting portions of each yarn, and drafting means for drafting said portions to form beards, said twisting means or other means being arranged to retwist the beards to form the splice, characterized by means to grip each yarn between nips at two locations (defining the respective yarn portion) which are spaced apart by a distance not significantly greater than the mean yarn fibre length, the drafting means being arranged such that, after untwisting, the beards are formed by drawing the ends of the yarns in opposite directions and longitudinally through the adjacent nips, whereby both ends of each beard are held between the nips defining the respective yarn portion.

The yarns to which the invention is applicable include, in the simple case, those in which there is substantially singles twist. Such a class embraces two-fold yarns which possess both stable ply twist and stable strand twist but in which the strand twist as well as the ply twist can be removed simply by unwinding the ply twist.

In one embodiment, said twisting means comprises a pair of annular discs which are arranged in mutual register to define an annular nip in which the yarns may be laid and means to effect contrarotation of said discs. The untwisted portions of the yarn, which can be crossed or parallel within the discs, may then be drafted by grippers located outside the discs and positioned to move transversely to a general direction in which the yarns are laid, whereby the yarns are simultaneously drafted to part the yarns and the resultant beards brought together or almost together, still nipped by the contrarotatable discs. Contrarotation of the annular discs in the opposite direction is then effected to twist the components of the beards about each other and so join the yarns in a splice.

The invention will be further described, by way of example only, with reference to the accompanying drawings, in which.

Figure 1:
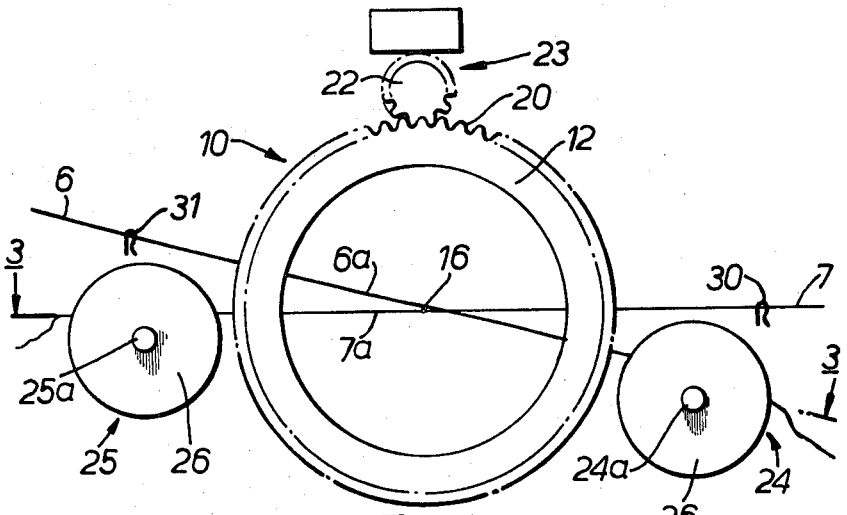
FIG. 1 is a schematic plan diagram of splicer apparatus in accordance with the invention, shown immediately subsequent to introduction of the yarns to be spliced.
Figure 3:
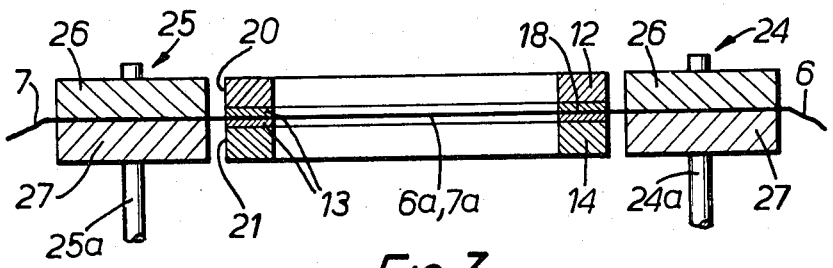
FIG. 3 is a cross-section on the line 3—3 in FIG. 1.

The yarn splicer apparatus 10 illustrated in FIGS. 1 to 3 includes a pair of annular discs 12, 14 journalled (in structure not shown) on a common axis 16 so as to lie in mutual register and thereby define an annular yarn gripping nip 18 (FIG. 3). Discs 12, 14 are provided on their opposed faces with a suitable high-friction coating 13 such as a polyurethane formulation and are separable, either by relative axial movement or by a hinging action, to permit ready insertion of yarns across the nip 18. For reasons to be explained, the discs 12,14 are dimensioned to have a diameter not significantly greater than, and preferably about equal to, the mean fibre diameter of the yarns to be spliced.

The outside rims 20, 21 of discs 12, 14 are toothed for engagement with respective pinions 22 of control means 23. Control means 23 concludes a suitable drive, and appropriate gearing in train with pinions 22, whereby actuation of the drive is effective to contrarotate discs 12, 14 with a substantial speed reduction ratio.

Disposed at approximately opposite positions outside discs 12, 14 are respective yarn grippers 24, 25. Grippers 24, 25 each comprise a pair of jointly rotatable discs 26, 27 separable on pivot pins 24*a*, 25*a* to receive a yarn between them but able to grip the yarn to such an extend that rotation of the disc pair is effective to pull the yarn through nip 18. The axes of grippers 24, 25 are located on a line slightly offset from a diametral plane of discs 12, 14.

Disposed approximately diametrically opposite each gripper 24, 25 is a fixed yarn guide 31, 30 which is spaced from the other gripper so that a yarn placed through the guide, across discs 12, 14 and held in the respective gripper does not contact the discs of the other gripper. A setting device (not shown) may be positioned above or below the plane of the annular nip for applying heat (hot air supply or heated plate), size, steam, or adhesive to the adjacent yarns, for purposes hereinafter described.

In use of the apparatus just described, and illustrated in FIGS. 1 to 3, discs 12, 14 are separated to open up the nip 18 and a pair of yarns 6, 7 which are suitably staple yarns having substantially singles twist are placed through the respective guides 30, 31 and laid across the face of the lower disc. The yarns are crossed in the region of axis 16 and placed off-centre between the separated discs 26, 27 of the respective grippers 24, 25. Discs 12, 14 are then closed together to define annular nip 18, in which yarns 6, 7 are gripped to define lengthwise portions 6*a*, 7*a* of the yarns within the discs. This is the condition depicted in FIG. 1.

Rotation of pinions 22 to effect contrarotation of discs 12, 14 through a relatively small arc will now friction twist portions 6*a*, 7*a* of yarns 6, 7 by rolling the yarns between the disc surfaces to rotate the yarns, whereby to substantially untwist or slightly reverse twist the fibres thereof. In effect, removed twist is stored in the tails and in the trailing main portions of the yarns.

Figure 2A:
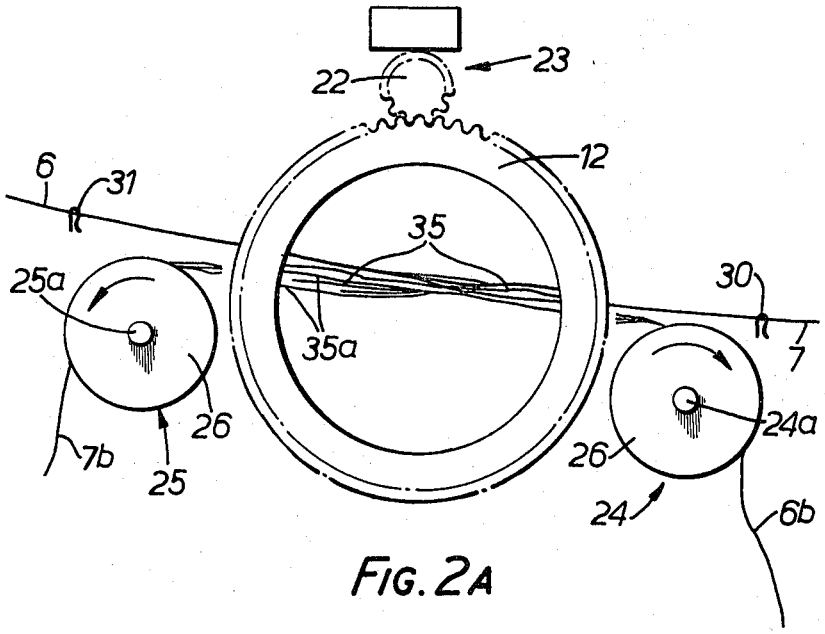
FIGS. 2A and 2B are views similar to FIG. 1 but showing the positions of the respective yarns immediately prior to and subsequent to the final retwisting step.

Once the components of yarn portions 6*a*, 7*a*, are substantially untwisted from each other, discs 26, 27 are closed tight and rotated oppositely to bring yarn portions 6*a*, 7*a* to respective positions in which they lie substantially alongside each other in close proximity or even in contact. During this and further movement of discs 26, 27 the yarns are pulled through nip 18 and thereby drafted so as to part them within portions 6*a*, 7*a* in the region within the discs (FIG. 2A). Each gripper may then be opened to release the yarn tail 6*b*, 7*b* to prevent interference with the primary yarns.

It will be appreciated that the grippers 24, 25 comprised of rotatable disc pairs form both means to draft and so part the yarns, and, in cooperation with guides 30, 31 means to arrange the resultant beards substantially alongside and closely adjacent or in contact with each other.

Each yarn is now provided with a beard 35 (FIG. 2A) or end portion in which the fibres of the yarn are substantially not twisted or relatively slightly twisted about each other. If the diameter of the discs is indeed not significantly greater than the mean fibre length of the yarns to be spliced, as earlier indicated, the "free" ends of some of the fibres will be held in nip 18, thereby preventing the beards from uptwisting to any appreciable extent. Such nipped fibres are highlighted at 35*a* in FIG. 2A.

Figure 2B:
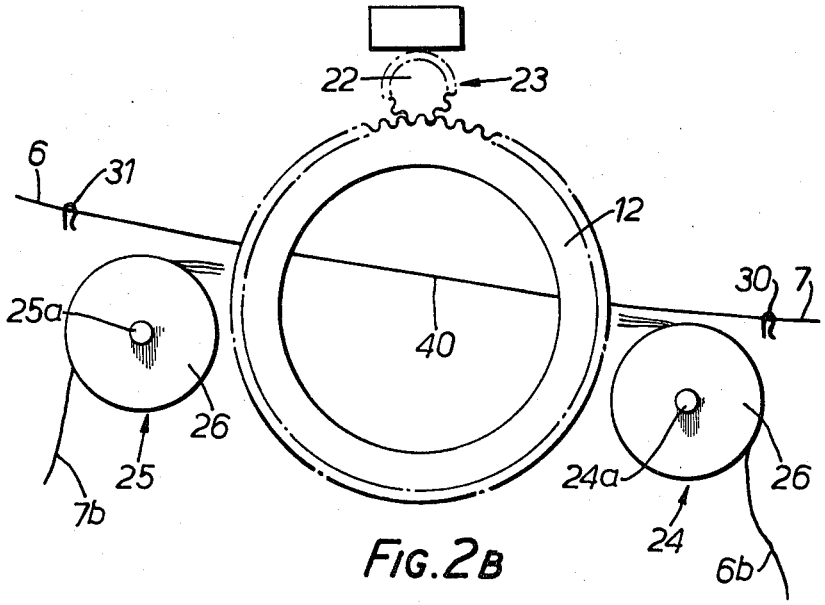

The discs 12, 14 may then be rotated slightly further in the same sense as before to more closely align beards 35. With or without this step, reversal of discs 12, 14 to contrarotate them in the direction opposite to the earlier rotation is effective to cause the fibres of the respective adjacently laid beards to interact by twisting about each other as the stored twist is run out into the beards, whereby the yarns are joined together in a splice 40 (FIG. 2B). Such second contrarotation preferably returns the discs beyond their original positions in order to somewhat overtwist the splice. The overtwisting may be such that stresses in the yarns exceed elastic limits thus achieving permanence in the splicing twist. Alternatively, the splice may be stabilised by a brief twist setting treatment applied by a setting device as aforementioned, by way of heat, size, steam or adhesive. An important advantage of the splicer apparatus shown in FIGS. 1 to 3 arises from the inclusion of a friction twisting device for untwisting the yarn portions 6*a*, 7*a* and retwisting the beards 35 to form the splice 40. Discs 12, 14 provide oppositely moveable friction surface portions at each gripping point on each yarn, which untwist the yarns by rolling and thereby rotating them. It is found that friction twisting obviates the need to detect the point of zero-twist or to externally compensate for random perturbations in the yarn twist. Three effects are believed to play a part in the compensation. On the one hand, yarn perimeter is broadly inversely proportional to the degree of twist: because friction twisting is a peripheral surface interaction, a higher twist entails smaller perimeter and thereby more turns during untwisting. A second effect is the observed flattening about zero-twist of the twist/disc-rotation characteristic. Lastly, it is found that any residual twist in the untwisted segments is negated at the commencement of the drafting step. This is best achieved with a slight reverse twist since cancelling opposite twist is initially pulled through the nip 18. For such reason, it is preferred to slightly reverse twist yarns of average twist in the segments within the nip 18.

In an alternative arrangement, the grippers 24, 25 may be diametrically opposed to each other and the yarns laid on opposite sides of their axes. This is an advantage when yarns are hairy and the crossed arrangement of FIG. 1 introduces undue interference between yarns during the untwisting phase.

In other alternative constructions, capstans may be substituted for each disc pair 26, 27 or grippers 24, 25 may be constituted by linearly moveable pairs of gripping jaws which might move in respective parallel tracks in the same direction or in opposite directions.

Figure 4:
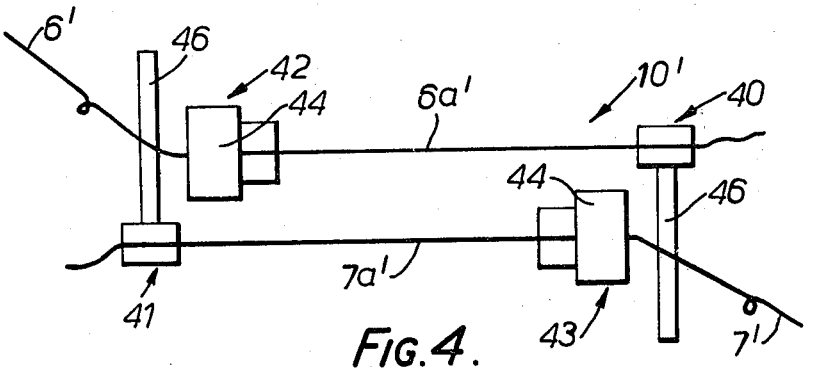
FIG. 4 is a schematic plan diagram of an alternative apparatus for carrying out the invention.

A still further arrangement 10' in accordance with the invention is schematically shown in FIG. 4. In this case, the initial twisting phase in which the components are untwisted is not positively effected at both ends of a defined portion of each yarn 6',7'. Each portion *6a', 7a'* is here defined at one end by a simple gripper 40, 41 and at the other by a twisting device 42, 43 comprising co-planar rather than overlayed discs 44. (only the top disc is visible in FIG. 4). The contacting circumferences of each set of discs 44 define a single twisting nip for untwisting the respective yarn portions, *6a', 7a'*. Initial crossing of the yarns is not possible as it is necessary to prevent interference between the fibres of the respective yarns. However, as grippers 40, 41 draft the respective untwisted yarn portions *6a', 7a'* to form beards, it remains desirable that the grippers by moved transversely, in this case oppositely transversely along tracks 46, so as to bring the beards into a disposition in which they lie alongside each other closely adjacent or substantially in contact.

I claim:

1. A method for the splicing of two twisted staple yarns by untwisting portions of each yarn, drafting said portions to part the yarns and form two beards and retwisting the beards to form a splice, characterized in that the untwisting is effected by rolling the yarns between two surfaces at nip point to rotate the yarns.

2. A method for the splicing of two twisted staple yarns by untwisting portions of each yarn, drafting said portions to form beards and retwisting the beards to form the splice, characterized in that each yarn is gripped between nips at two locations (defining the respective yarn portion) which are spaced apart by a distance not significantly greater than the mean yarn fibre length and characterized in that, after untwisting, the beards are formed by drawing the ends of the yarns in opposite directions and longitudinally through the adjacent nips, whereby both ends of each beard are held between the nips defining the respective yarn portion.

3. A method according to claim 1 or 2 further characterized in that untwisting is effected by causing each yarn to roll by frictional contact between two oppositely moving surfaces so that the yarn is untwisted without substantial lateral movement.

4. A method according to claim 1 or 2 further characterized in that untwisting of each yarn portion is effected by rolling the yarn in opposite directions in a nip between two surfaces at each end of the yarn portion being untwisted.

5. A method according to claim 1 or 2 further characterized in that, after untwisting and drafting of the yarn portions, the beards so formed are retwisted in like manner (but in opposite direction) to the aforesaid untwisting.

6. A method according to claim 1 or 2 further characterized in that the portions of the yarns to be spliced are laid side by side prior to untwisting and are maintained side by side during untwisting and beard formation.

7. A method according to claim 1 or 2 further characterized in that the portions of the yarns to be spliced are laid upon one another in crossed relationship prior to twisting and are brought into side by side relationship either during untwisting or during beard formation.

8. A method according to claim 1 or 2 characterized in that the beards are retwisted substantially beyond the average twist level of the yarns and beyond the elastic limit of the yarns to confer a degree of permanent set in the splice so formed.

9. A method according to claim 1 or 2 further characterized in that, after retwisting, the twist in the splice so formed is set by the application of size, heat or the like prior to the release of the nips holding the yarns.

10. Apparatus for the splicing of two twisted staple yarns comprising untwisting means for untwisting portions of each yarn and drafting means for drafting said portions to part the yarns and form two beards, said twisting means or other means being arranged to then retwist the beards to form a splice, characterized in that the twisting means comprises two surfaces at nip point for rolling and thereby rotating the yarns.

11. Apparatus for the splicing of two twisted staple yarns comprising twisting means for untwisting portions of each yarn, and drafting means for drafting said portions to form beards, said twisting means or other means being arranged to retwist the beards to form the splice, characterized by means to grip each yarn between nips at two locations (defining the respective yarn portion) which are spaced apart by a distance not significantly greater than the mean yarn fibre length, the drafting means being arranged such that, after untwisting, the beards are formed by drawing the ends of the yarns in opposite directions and longitudinally through the adjacent nips, whereby both ends of each beard are held between the nips defining the respective yarn portion.

12. Apparatus according to claim 10 or 11 further characterized in that said twisting means comprises respective pairs of oppositely moving surface portions so arranged to roll each yarn by frictional contact that the yarn is untwisted without substantial lateral movement.

13. Apparatus according to claim 12 further characterized in that said twisting means for each yarn comprises spaced nips formed by pairs of surface portions arranged to define the respective said yarn portion to be untwisted.

14. Apparatus according to claim 13 further characterized in that said twisting means is reversible to cause the beards to twist about each other to an extent greater than the twist which was originally removed in said yarn portions.

15. Apparatus according to claim 14 further characterized by means disposed to set the splice by size, heat or the like.

16. Apparatus according to claim 15 further characterized in that said twisting means includes a pair of annular discs arranged for contrarotation in mutual register to define an annular nip in which the yarns may be laid.

17. Apparatus according to claim 16 further characterized in that the drafting means includes a pair of yarn grips disposed at approximately diametrically opposite locations about the discs.

18. Apparatus according to claim 17 further characterized in that said yarn grips comprise respective rotatable elements arranged to draft the yarns by winding them into or through the yarn grips.

* * * * *

UNITED STATES PATENT AND TRADEMARK OFFICE

CERTIFICATE OF CORRECTION

PATENT NO. : 4,407,117

DATED : October 4, 1983

INVENTOR(S) : Russell K. GARNSWORTHY

It is certified that error appears in the above-identified patent and that said Letters Patent are hereby corrected as shown below:

On the title page add:

[73] Assignee: Officine Savio S.p.A.
Pordenone, Italy

Signed and Sealed this

*Twenty-fourth* Day of *July 1984*

[SEAL]

*Attest:*

GERALD J. MOSSINGHOFF

*Attesting Officer*

*Commissioner of Patents and Trademarks*